United States Patent [19]

Wells

[11] 4,352,494

[45] Oct. 5, 1982

[54] REACTION DEVELOPMENT APPARATUS

[76] Inventor: Alfred A. Wells, 15700 Steel St., Detroit, Mich. 48227

[21] Appl. No.: 171,673

[22] Filed: Jul. 24, 1980

[51] Int. Cl.[3] ..... A63B 5/16; A63B 69/00

[52] U.S. Cl. ..... 273/1.5 A

[58] Field of Search ..... 273/1.5 A, 16 E, 16 GC, 273/16 GD, 370, 359, 55 R, 26 R, 26 E, 29 A; 272/67, 68, 93, 130

[56] References Cited

U.S. PATENT DOCUMENTS

| | | | |
|---|---|---|---|
| 1,463,931 | 8/1923 | Tucker | 273/370 |
| 3,588,104 | 6/1971 | Griffin | 273/26 E |
| 3,623,725 | 11/1971 | Setten, Sr. | 273/26 E |
| 3,940,132 | 2/1976 | Lopatto | 273/26 E X |
| 4,161,313 | 7/1979 | Dickey | 273/1.5 A |

*Primary Examiner*—Paul E. Shapiro

*Attorney, Agent, or Firm*—Cullen, Sloman, Cantor, Grauer, Scott & Rutherford

[57] ABSTRACT

A physical development and training device to enable a person to practice reaction skills such as jumping, leaping and springing to grasp a ball-like object. The device includes a turret mounted on a support base for rotation about a vertical axis. An articulated arm assembly has one end connected to the upper end of the turret to permit pivotal movement of the arm assembly. Actuating mechanisms are provided for pivoting the articulated arms toward and away from each other as the assembly undergoes pivotal and/or rotational movement relative to the support base. A suction retainer on the free end of the articulated arm assembly releasably retains the ball-like object, such as a basketball, enabling a person practicing rebounding to grasp and pull the basketball from the suction retaining means. A control center on the base controls the actuating mechanism providing predetermined movement of the basketball such that its path of travel may be programmed to accommodate persons of different height, age groups, coordination, etc.

4 Claims, 10 Drawing Figures

REACTION DEVELOPMENT APPARATUS

BACKGROUND OF THE INVENTION

Various types of devices have been employed for the general purpose of practicing leaping, jumping or springing by athletes for games such as basketball, football, volleyball or the like. Examples of prior basketball practice devices are disclosed in U.S. Pat. No. 3,105,683 to H. E. Kimbrell and U.S. Pat. No. 3,471,150 to G. Kaerwer. These relevant devices have had limited success because they are incorporated on basketball backboard units at a fixed height such as ten feet for a basketball rim. Thus, such devices are of little or no value in teaching leaping and jumping skills to young players being trained to rebound basketballs as they lack height adjustment means. Further, such devices involve first throwing a basketball through a basket rim or hoop before the ball is cast outwardly from the net by an ejecting device to a person practicing rebounding. The result is that younger or less skilled players who have limited basketball shooting ability derive minimal benefit from such training devices.

Another problem with prior basketball training devices such as disclosed in the U.S. Pat. No. 3,085,800 to A. J. Holstad is that the ball is ejected in a single arcuate path from within the basket. Actual rebounding occurs when the ball strikes and bounces off the backboard or rim and is returned in a random manner. A rebounding basketball may move through infinite paths of travel anywhere from a direct single linear or arcuate path to a composite path caused by the ball bouncing or being tipped in a multiplicity of directions.

A further problem with prior jumping and leaping training devices such as shown in the U.S. Pat. No. 2,939,705 to F. McCall, Jr., is that they lack any gauging means to enable a person to determine or measure their progress in developing their reaction skills such as rebounding a basketball and thus provide an incentive to constantly upgrade their ability.

Still another problem with prior training devices is that they do not develop a player's ability to intercept or block a basketball that is being passed or thrown toward the basket. Also, prior patents fail to teach a training device that releasably retains a basketball to develop the player's hand strength and dexterity in gaining control of the ball such as from an opposing player.

Thus, the invention herein relates to a physical training device for improving the jumping, leaping and ball retrieving reaction skills of persons of all heights, ages and level of abilities. The device is also intended as a coordination and reaction development apparatus, such as hand/eye coordination, for handicapped persons or persons undergoing a program of rehabilitation therapy.

SUMMARY OF THE INVENTION

The physical exercising and reaction skills practice device of this invention, in its preferred form, is disclosed as a basketball game training device for players of all heights, ages, levels of coordination and game experience. A basketball is releasably held by suction retaining means on the free end of an arm assembly for movement through predetermined paths of travel. A feature of the device is to enable a player to practice rebounding by retrieving a basketball from the device as it causes the ball to be moved in an almost infinite number of random paths of travel. The device simulates, for example, the ball bouncing off the backboard or rim after an unsuccessful attempt to make a basket. The device moves the basketball in one or several composite degrees of freedom simulating the ball travel while it is being passed, shot, blocked, tipped, etc.

In general, the device comprises a base supporting an upright turret member for rotation about an essentially vertical axis. The turret has its upper end connected by a primary pivot to one end of an articulated arm assembly. Drive means are provided to rotate the turret on its base about its vertical axis while at the same time pivoting the articulated arm assembly for vertical swinging movement toward and away from a desired location. Additional drive means are provided for pivoting primary and secondary arms of the assembly about a secondary pivot relative to each other.

A retaining device, such as a flexible suction cup, is located on the free end of the secondary articulated arm for releasably retaining a basketball or other resilient ball-like object such as a football, volleyball or the like. A vacuum line provides communication with a vacuum source for maintaining a vacuum in the suction cup from the time the suction cup contacts the basketball. An elastomeric bellows supports the cup on the arm in both a radially and axially flexible manner.

It is a feature of the invention which enables the basketball to be retained at predetermined or adjustable suction pressures to control the force required by a user to pull the basketball from the flexible suction cup during the course of its travel. The user is thus urged to "attack" and retrieve the releasably held basketball from the device by leaping, jumping, or springing for the ball as it is moved in a simulated rebounding path while developing reaction skills such as ball handling and hand/eye coordination.

A microprocessor controls the operating parameters such as speed and direction of rotation of the various drive motors together with the vacuum source at a control center on the training device. The device may be programmed by means of three independent dimensional variables or degrees of freedom by power actuating motors to cause the basketball to be moved toward or away from selected locations requiring a player to jump or leap for the basketball as it follows predetermined paths. The micro program may be separated and put on a replaceable chip to enable each user to program the system. Thus, the invention contemplates an alterable control memory which can be reprogrammed by cards, paper tape, etc., to change the computer's set of instructions for each user. The speed and movement of the ball may then be altered by the microprocessor control memory to accommodate users of different reaction skills. For example, the machine can be instructed by the control center to duplicate game conditions in conformity with younger players of limited skills or to emulate a set of ball movements to challenge a professional basketball player.

Other advantages and meritorious features of the disclosed invention will be more fully understood from the description of the preferred embodiment, the appended claims and the drawings, a description of which follows.

PREFERRED EMBODIMENT OF THE INVENTION

Figure 1:
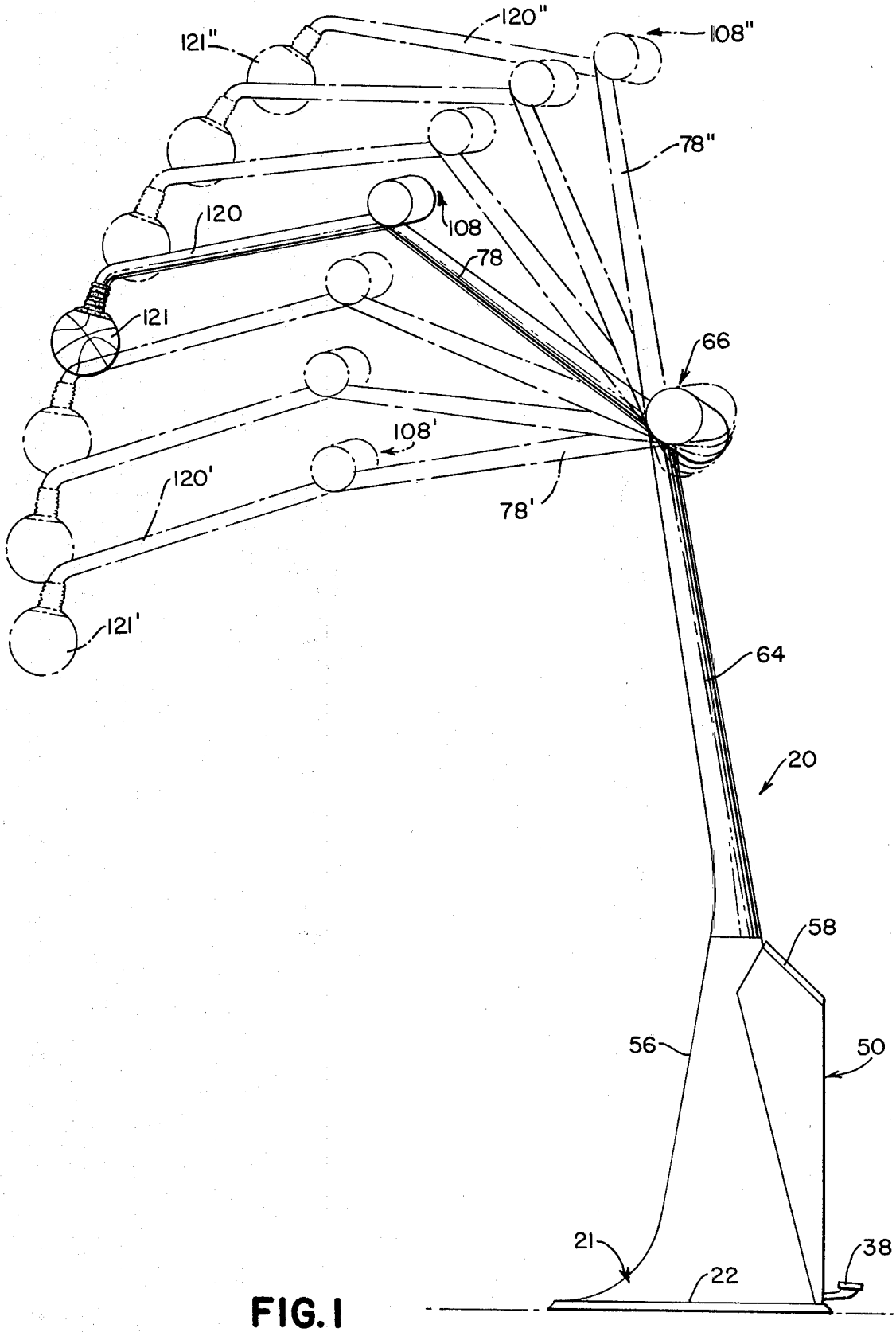
FIG. 1 is a side elevational view of the device showing the articulated arm assembly moved through a series of positions.
Figure 2:
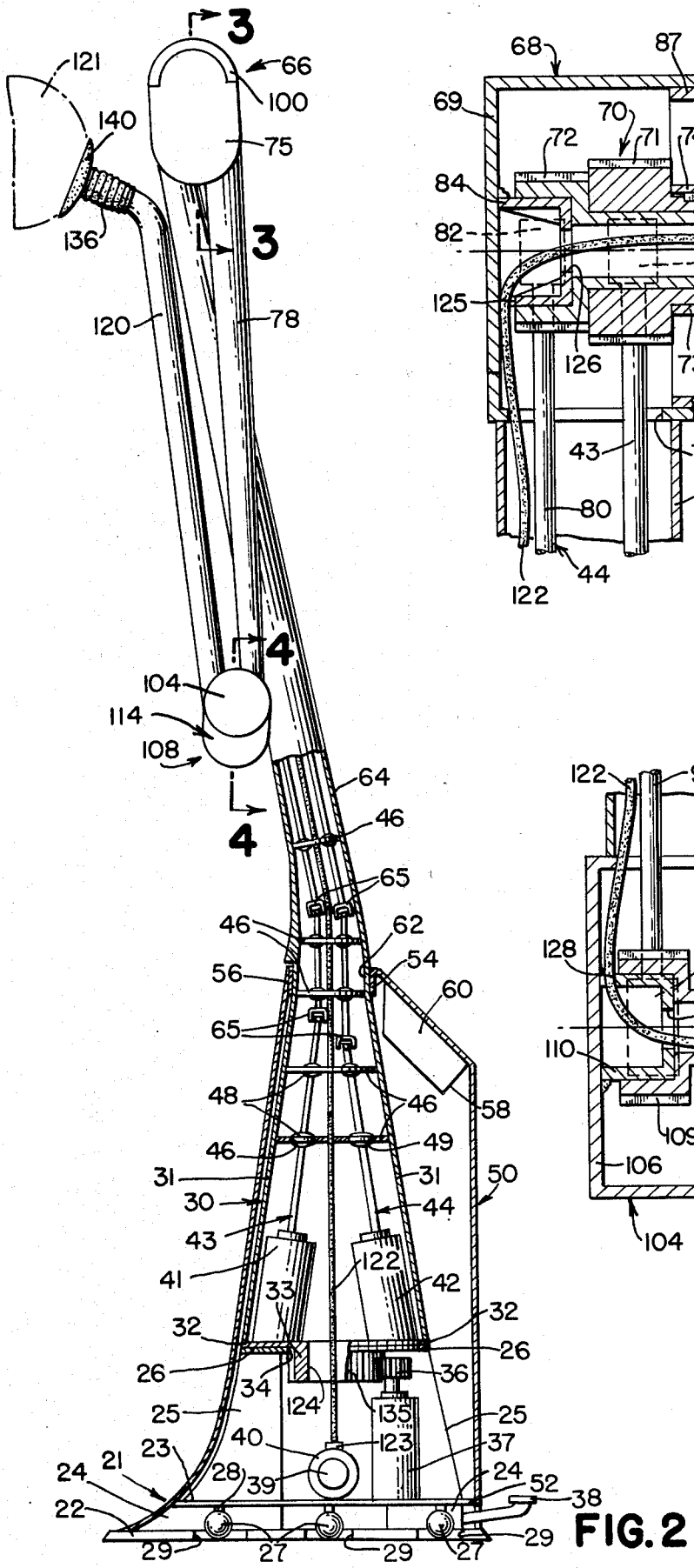
FIG. 2 is an enlarged vertical sectional view through the rotating turret portion of the invention.

FIGS. 1 and 2 show the physical reaction trainer, generally indicated at 20, comprising a support base 21 having a lower platform 22 and an upper platform 23 connected by a plurality of vertical lower risers 24 radiating from the base vertical axis. A plurality of upper radiating risers 25 are fixed on the upper platform 23 with a circular track-defining ring 26 shown supported on the upper ends of the risers 25. The base 21 is movable over a surface by means of plurality of casters 27 retained on the underside of the upper plate 23 by radiating arms 28 for movement between an upper retracted position and a lowered position wherein the casters extend through lower platform holes 29 to roll on a support surface.

The base 21 has rotatably supported thereon a turret assembly 30 for rotation about an essentially vertical axis. The turret assembly includes a plurality of upwardly and inwardly converging spar members 31 with their lower ends fixed at annular spaced locations to an outwardly extending flange ring 32 of a hub member 33 journally supported in central aperture 34 of the track ring 26. The flange ring 32 thus freely rotates or swivels on the upper surface of the track ring 26 to allow the turret to turn in a horizontal plane. An external spur gear 35 is fixed on the lower end of the turret hub 33 in driven engagement with a turret drive pinion gear 36 driven by turret power actuating means in the form of drive motor 37 fixably supported on upper platform 23.

A caster adjustment foot pedal 38 operates the bank of casters such that when the user steps on the pedal the casters are lowered through the holes 29 to allow the trainer to be easily moved over the support surface. A vacuum source in the form of a vacuum pump 39 in communication with a tank 40 is supported as a unit on the upper platform 23 for a purpose to be explained.

The turret assembly further includes first and second arm power actuating means in the form of primary and secondary variable speed, reversable drive motors 41 and 42 respectively, mounted on the flange ring 32. The drive motors 41 and 42 rotate primary and secondary drive trains having sections or shafts 43 and 44 respectively, to provide a separate drive path to each pivot means to be described. The drive shafts 43 and 44 are supported in a series of horizontally disposed, vertically spaced turret support disks, shown at 46, suitably connected around their outer peripheries to the spar members 31 such as by welding. The disks 46 each have a pair of swivel bearing members 48 located in apertures 49 receiving their associated drive shaft sections therethrough allowing each drive train to be rotated either in a clockwise or counter-clockwise direction relative to the disks.

A rectangular section box-post member 50 is supported as by welding on the base 21 from heel portions 51 and 52 of the lower and upper platforms 22 and 23. The box-post in turn supports a fixed outer collar 54 formed at the upper end of turret conically shaped outer turret cover plate 56. The box post member 50 has a cabinet 58 at its upper end enclosing a control center in the form of a microprocessor package 60 to be explained.

The stationary outer collar 54 journally supports therein a turret arm inner collar portion 62 fixed on the lower end of a tubular or hollow turret arm or stanchion member 64. The upper end of the turret spar members 31 are fixed to the turret collar portion 62 such that the turret assembly 30 and turret arm 64 rotate as a unit about the support base 21. The drive shafts 43 and 44 are joined by suitable universal joints 65 to allow each drive train to be angled for extension upwardly within the turret arm in conformity with its principal axis.

The turret arm 64 extends upwardly from the turret assembly in a canted or tipped manner with the turret arm axis at an inclination to the substantially vertical axis of the turret assembly. The turret assembly and turret arm are joined as a single unit such that upon rotation of the turret spur gear 35 the turret arm 64 revolves in a nutating manner about the turret assembly vertical axis defining a conical surface during a full 360° rotation, because of the inclined orientation of the turret arm. The angle of inclination of the turret arm in the disclosed form is of the order of 12° from the vertical.

Figure 3:
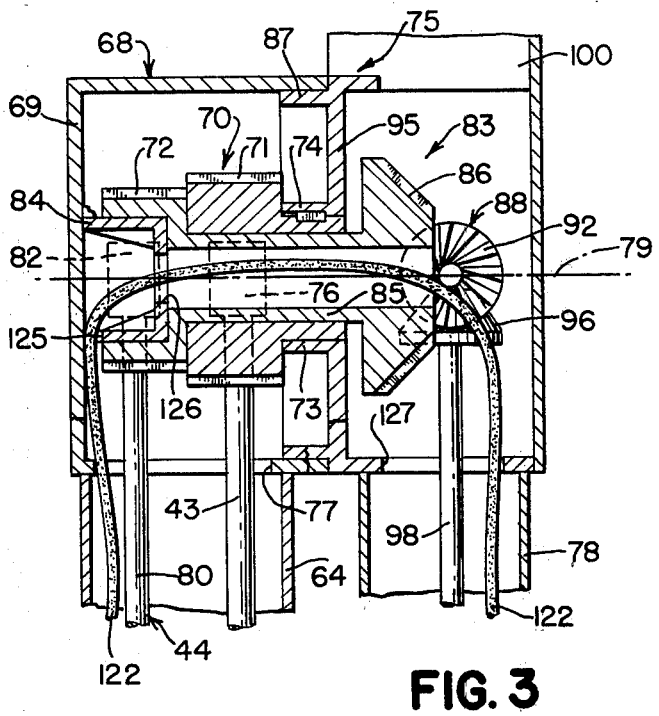
FIG. 3 is a fragmentary vertical sectional view with parts broken away taken through the primary pivot on line 3—3 of FIG. 2.
Figure 6:
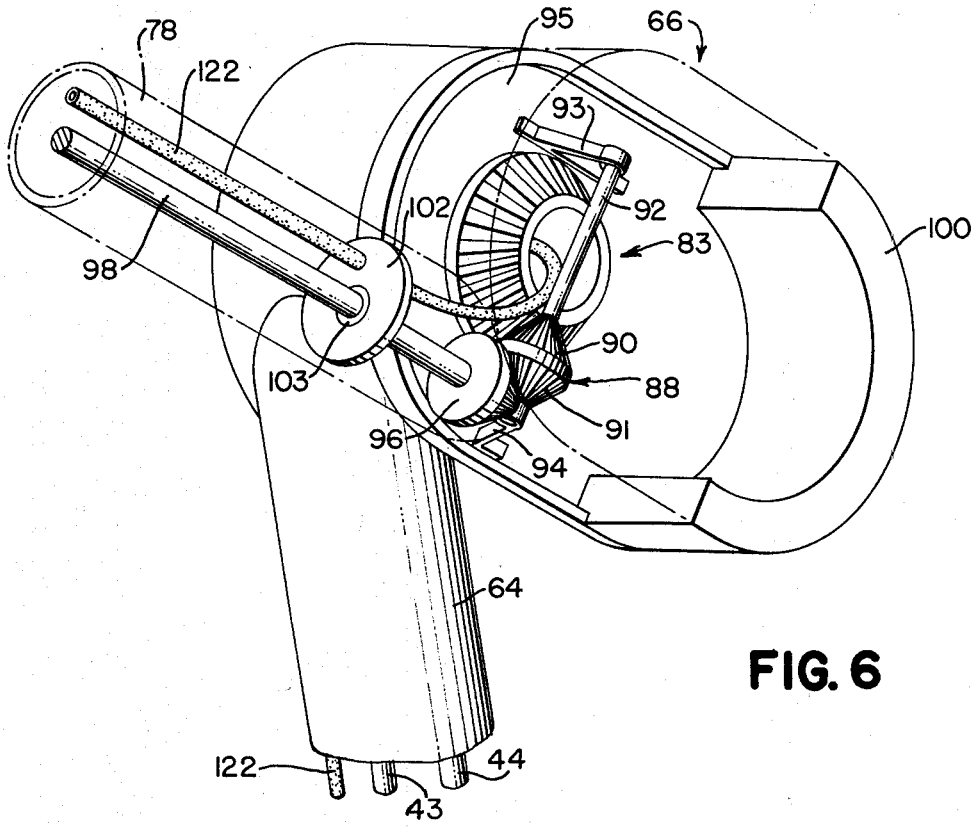
FIG. 6 is a fragmentary perspective view similar to FIG. 3 showing the output gear arrangement of the primary pivot.
Figure 5:
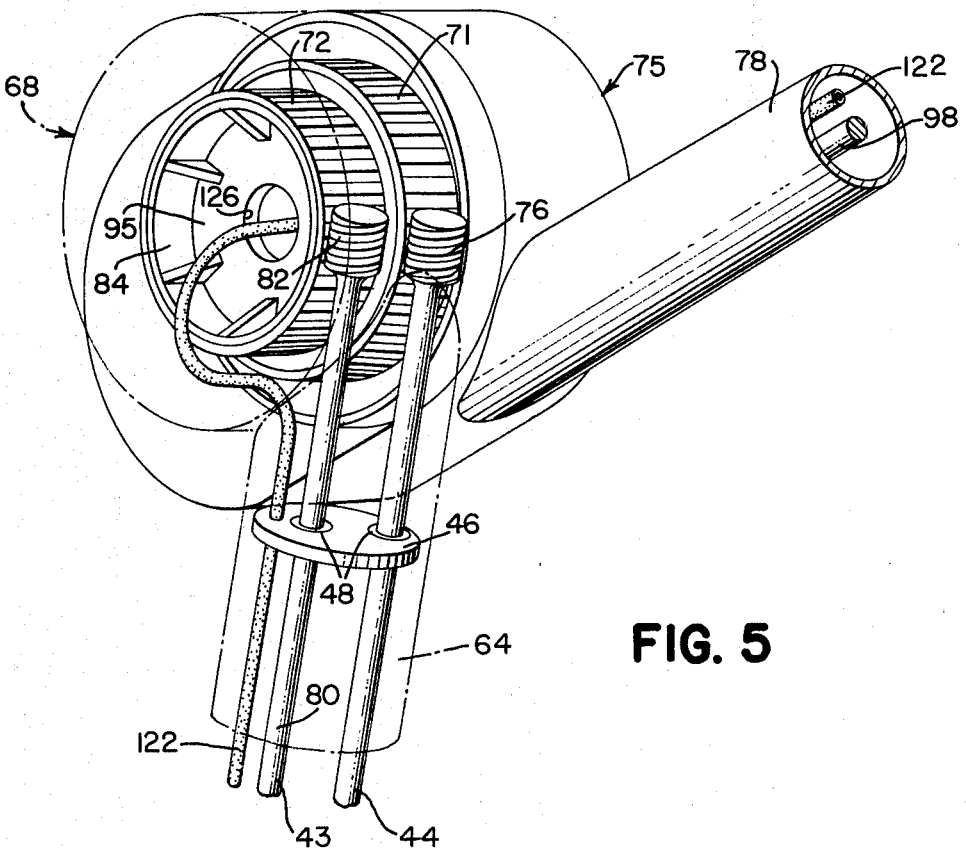
FIG. 5 is an enlarged fragmentary perspective view of the primary pivot with the gear housing removed and parts broken away to show the input gear arrangement.

As seen in FIGS. 3, 5 and 6 the upper end of the turret arm 64 terminates in primary pivot means 66 having a cylindrical gear housing 68 fixedly connected to the free end of the turret arm 64. FIG. 3 shows gear housing 68, including a base wall 69, having primary speed changing gear means 70 including first 71 and second 72 relatively rotatable coaxially arranged ring gears respectively, located on the axis of the primary pivot. The first larger ring gear 71 has a hub 73 keyed in trunion 74 of a pivot casing 75 whereby rotation of ring gear 71 pivots casing 75.

The first ring gear 71 is driven by worm gear 76 fixed on the free end of the primary drive shaft 43. FIG. 5 shows the drive shaft 43 extending through an opening 77 in the gear housing 68 communicating with the interior passage of the turret arm 64. The drive shaft 43 has an output which can be varied by its drive motor 41 as to its rotative speed and direction in conjunction with the gear ratios of gears 71 and 76. Thus, drive motor 41 rotates the pivot casing 75 in either a clockwise or counter-clockwise direction relative to the gear housing 68 to cause swinging movement of an articulated arm assembly including primary and secondary swing arms to be described.

The pivot casing 75 supports one proximal end of a primary tubular swing arm 78 of the arm assembly such that rotation of the casing 75 by primary drive shaft 43 causes the primary swing arm 78 to pivot about axis 79 of the primary pivot means 66 for arcuate movement toward and away from the turret arm 64. FIG. 1 shows the primary swing arm 78 having an arcuate path of movement from a substantially right angled phantom line position 78' relative to the turret arm 64 to a substantially colinear phantom line position 78'' relative to the turret arm 64. FIG. 2 shows the primary swing arm 78 pivoted to its downwardly extending storage position in substantial 180° opposed relation to its upwardly extending 78'' position of FIG. 1.

As viewed in FIGS. 3 and 5, the secondary drive shaft or train 44 includes a first shaft section 80 having a worm gear 82 in meshed driving relation with the second ring gear 72 for driving a secondary pivot transmission 83 shown in FIG. 6. The gear 72 is journalled on a pivot hub 84 suitably fixed on the interior base wall 69 of gear housing 68 as by welding. FIG. 3 shows the ring gear 72 mounted on one end of a hollow shaft 85 extending on the pivot axis through the hub 73 with the shaft 85 other end supporting a straight beveled gear 86 of the secondary transmission 83 thereon. It will be noted that the pivot casing 75 includes a reduced diameter bearing annulus portion 87 journally supported within the circular open end of the primary gear housing 68.

In FIG. 6 the beveled gear 86 drives a double cone gear 88 of the secondary pivot transmission 83 having an input portion 90 and an output portion 91. The double cone gear 88 is supported on one end of pivot shaft 92 with its axis extending transverse to and intersecting the primary pivot axis 79. The cone gear shaft 92 is journalled in brackets 93 and 94 fixed on base wall 95 of the pivot casing 75. The output portion 91 of the double cone gear 88 drives a single cone gear 96 of a second shaft section 98 of the secondary drive train assembly 44.

The primary pivot casing 75 includes a semi-circular or C-shaped counterweight portion 100 positioned to counterbalance the weight of the articulated arm assembly including primary swing arm 78, by exerting an opposing torque in response to the force of gravity acting on the swing arm assembly.

Figure 4:
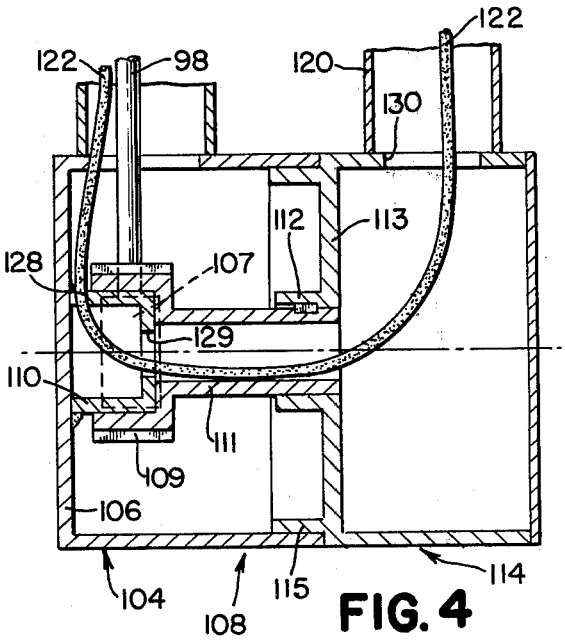
FIG. 4 is a fragmentary sectional view with parts broken away taken through the secondary pivot on line 4—4 of FIG. 2.
Figure 7:
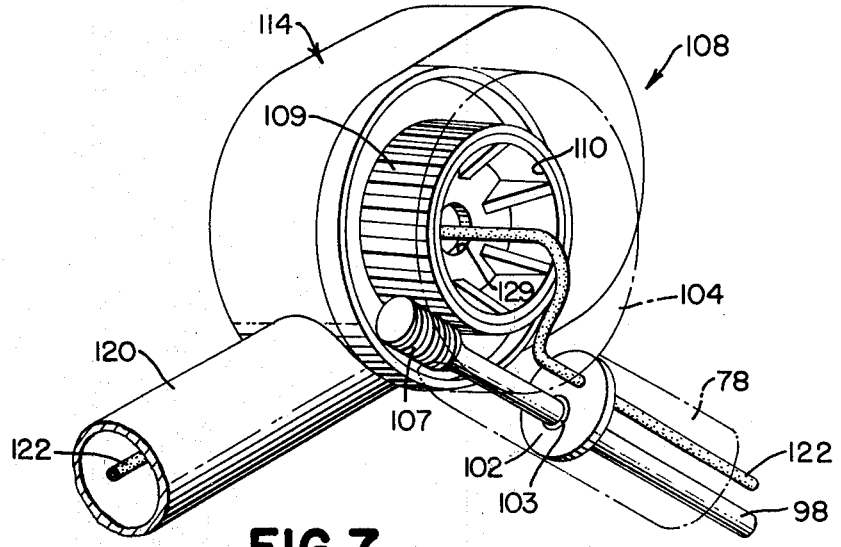
FIG. 7 is an enlarged fragmentary perspective view of the secondary pivot, with parts broken away to show the gear arrangement.
Figure 8:
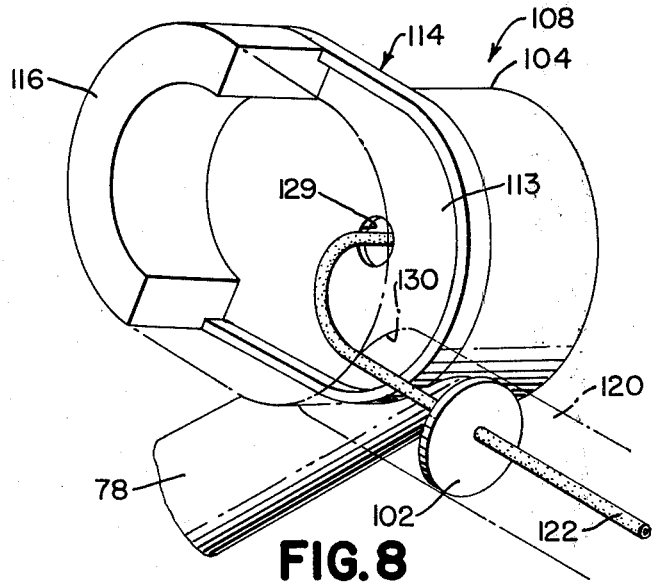
FIG. 8 is an enlarged fragmentary perspective view, with parts broken away showing a portion of the secondary pivot.

FIGS. 6 and 7 show the secondary drive train second shaft section 98 supported within the primary swing arm 78 by disks 102 provided with swivel bearings 103. The primary swing arm 78 has its outer or distal end fixed to secondary pivot gear housing 104. As seen in FIG. 4 the second drive shaft section 98 extends through an opening 105 in the cylindrical wall of secondary pivot gear housing 104 to allow for the passage of worm gear 107 therethrough. The worm gear 107 is fixed in the end of the shaft section 98. The worm gear 107 of secondary pivot 108 drives a secondary ring gear 109 journalled on a hub 110 suitably affixed as by welding on the inside surface of the housing base wall 106.

The secondary ring gear 109 is fixed on one end of a hollow tube 111 keyed within the bore of a trunion 112 extending outwardly from the base wall 113 of secondary pivot casing 114. The secondary pivot casing 114 is rotatably journalled in the open cylindrical end of housing 104 by means of its reduced diameter bearing annulus portion 115.

The secondary drive train second shaft section 98 has an output which can be varied as to its rotative speed and direction at its worm gear 107 to rotate the secondary pivot casing 114 in either a clockwise or counterclockwise direction relative to the secondary housing 104. The secondary pivot casing 114 has a semi-circular or C-shaped counterweight portion 116 to counterbalance the weight of the secondary swing arm 120 in a cooperating manner with primary pivot counterweight 100.

The secondary swing arm 120 is suitably fixed on the pivot casing 114 such as by welding, for arcuate swinging movement by second power actuating means or drive motor 42 toward and away from the primary swing arm 78 in an offset parallel path. FIG. 1 shows the secondary swing arm 120 movable in an arcuate path from a slightly greater than right angled phantom line position 120'', to a substantially colinear phantom line position 120' relative to the primary swing arm 78. It will be noted in FIGS. 1 and 2 that the secondary swing arm 120 has a length substantially equal to the primary swing arm 78.

By virtue of the primary and secondary pivotal arrangement described above it will be seen that the turret arm 64 supports the articulated arm assembly in the form of primary and secondary swing arms 78 and 120 respectively, by means of primary and secondary pivots 66 and 108. An inflatable ball-like object, such as, for example, a basketball 121, is supported in a manner to be described on the free, distal end of the secondary swing arm 120 having three independent spacial dimensions or degrees of motion, relative to predetermined selected locations about the training device. As the arms 64, 78 and 120 may each be moved at a variable speed the apparatus provides a fourth "degree" controlled variable relative to the movement of the ball-like object.

FIG. 2 shows internal line means, in the form of a flexible vacuum line 122, having one end coupled by means of a swivel connection 123 for communication with vacuum source or tank 40. The vacuum line 122 extends upwardly through hub aperture 124 and vertically aligned holes in turret disks 46 for passage through apertures in turret arm disks 46. By this arrangement the turret assembly and arm rotate with the vacuum line 122 relative to the vacuum tank 40.

FIGS. 3 and 5 show the vacuum line 122 extending vertically within the turret arm 64 and passing through the opening 77 into gear housing 68. A hub side aperture 125 provides a path for feeding the line 122 through axial bore 126 of pivot hub 84. The line 122 extends through the hollow shaft 85 exiting the bore of beveled gear 86 for passage through casing opening 127 into primary swing arm 178. The vacuum line 122 is fed through openings in disks 102 for passage in substantial parallel relation to the secondary drive shaft section 98.

The vacuum line 122 exits the primary swing arm 78 other open end and passes through the secondary housing opening 105 and pivot hub side aperture 128 and axial bore 129 as seen in FIG. 4. The line extends through tube 111 into pivot casing 114, and exits by means of its aperture 130, for passage into the secondary swing arm 120.

Figure 9:
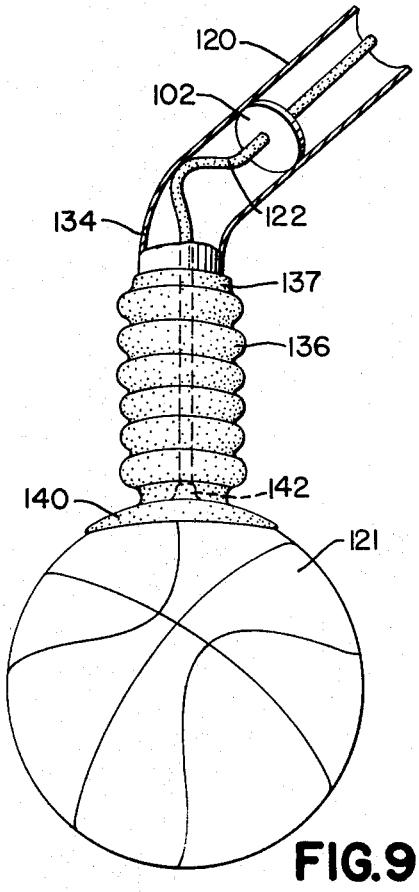
FIG. 9 is an enlarged perspective view with parts broken away showing the suction retaining means of the secondary swing arm.

FIG. 9 shows the secondary swing arm disks 102 supporting the vacuum line 122 for passage through the secondary arm curved free end 134 for entry into an energy-absorbing flexible undulated tubular member in the form of a flexible hose-like bellows 136. The bellows has a collar portion 137 at its one end for telescopic coupling with the secondary swing arm free end 134. The bellows 136 encloses the vacuum line 122 in a concentric manner with the bellows formed of suitable elastomeric or rubber material so as to be flexible both radially and axially with respect to the secondary swing arm.

Figure 10:
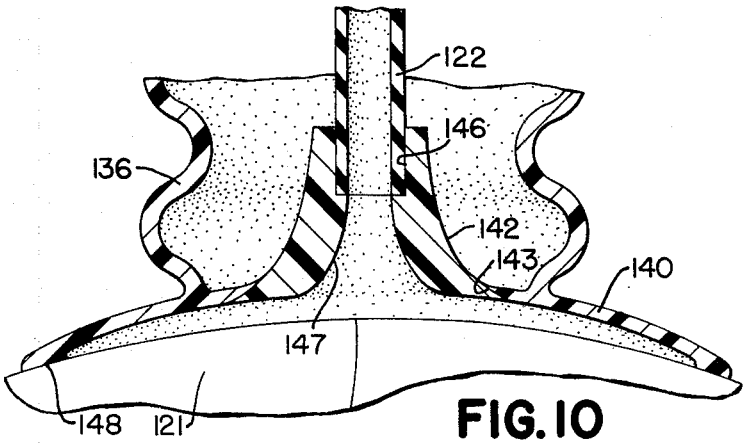
FIG. 10 is an enlarged, fragmentary vertical sectional view of the suction cup and nozzle portion of FIG. 9.

FIG. 10 shows the bellows 136 with its outer end supporting suction retaining means in the form of a flexible suction cup 140 which is preferably intricately molded with the bellows 136. The outer end of the vacuum line 122 terminates in a nozzle portion 142 sealingly mounted in a central aperture 143 in the suction cup 140. A swivel connection (not shown) may be provided in nozzle counter bore 146 of its passage 147 permitting relative rotation between the free end of the line 122 and the nozzle 142 allowing the suction cup and bellows 136 to rotate relative to the vacuum line 122.

It is to be understood that the suction cup 140 may be provided with different degrees of curvature and diameters so as to retain various ball-like objects in a releasable manner wherein the holding force may be adjusted by the vacuum pump. In the disclosed form of the invention the suction cup is shown supporting a standard size basketball 121. The suction cup design is such, however, that various inflatable objects such as volley balls, for example, could be releasably retained by the suction cup 140. Further, the invention contemplates a suction cup having an oval or eliptical shape wherein other hand graspable ball-like objects, such as footballs, may be retained on the free end of the secondary swing arm.

The flexible suction cup 140 is shown in FIG. 10 having its periphery 148 in sealed contact with the surface of the basketball 121 defining a suction space 149 which is in communication, by means of the vacuum line 122, with the vacuum source or tank 40. By controlling the speed of the vacuum pump 39 the atmospheric pressure in space 149 is controlled at predetermined levels. Thus, a constant or a variable suction is provided in the space 149 to maintain or vary the suction holding force by the cup 140 on the basketball.

In operation as indicated above, the secondary swing arm free end moves the basketball in a multiplicity or almost infinite number of paths by virtue of the training apparatus having three independent degrees of motion provided by its rotating turret 30 and turret arm 64 together with its primary and secondary pivotal swing arms 78 and 120, respectively. The ball may be rotated through a horizontal or lateral path of movement about the vertical axis of the turret assembly to provide a first degree of motion. The ball 121 may also be moved in an up-and-down path relative to any selected location on the surface by secondary pivot means 110 varying the angular relation of the primary and secondary arms in unison with the articulated arms being pivoted about the axis of the primary pivot means 66.

Further, by simultaneously rotating the turret arm 64 about the vertical axis of the turret assembly 30 in unison with a rotational movement about the primary pivot means 66 and the secondary pivot means 108 the ball may be caused to travel through a multiplicity of paths to simulate a basketball being rebounded, tipped, shot, passed, etc. Thus, for example, with a user positioned at a selected location on the surface supporting the training device the ball 121 follows a range or path of movements descending from a raised phantom line zenith position at 121'' to a lowered position 121' wherein rebounding may be exercised. A reverse path of the ball from a nadir position 121' to a zenith position 121'' allows the user to practice a shot blocking exercise.

A microprocessor located at the control center 60 may be programmed for activating, deactivating, and controlling the operating parameters or speeds of the power means in the form of turret drive motor 37, the primary swing arm drive motor 41 and the secondary swing arm drive motor 42. By providing a preselected time sequence of instructions to the power means three degrees of independent motion or any combination thereof together with a fourth degree of speed may be imparted to basketball. The apparatus provides a rotating movement in a horizontal plane about the turret vertical axis, arcuate movement of the articulated arm assembly about primary pivot means 64 toward and away from a selected location, and arcuate movement of the secondary arm 120 about secondary pivot means 120 relative to the primary swing arm 78.

The control center has suitable means for sensing the gear teeth such as, for example, with a twin unit magnetic pick-up (not shown) to provide a position pulse for every degree of angle. Thus, a program may be entered at the control center on cards, tapes, etc. to operate the device through a predetermined series of rebounding, passing, shot blocking, etc. exercises. Further, each user may reprogram the control center to a particular set of instructions to accommodate users of different age groups, coordination levels and reaction skills.

It will be understood that various modifications may be made to the embodiment of the reaction development apparatus disclosed. For example, friction, "Pancake," belt, etc. variable speed drive arrangements could be used in place of the worm gear constant mesh drive system disclosed depending upon the structural, space and cost requirements of the device. Further, various components of the disclosed embodiment may be modified, as required, for different types of installations. It is contemplated, for example, that the articulated arm assembly may be supported from a wall or basketball backboard rather than by a support base on a ground or floor surface.

The disclosed four "degrees" of freedom of travel for the ball-like object, i.e., three dimensional together with variable speed, is only one of several sequences which may be utilized for the reaction development apparatus. Thus, any number of degrees of freedom from one to four may be optionally selected. For example, the ball-like object may be moved about a single pivotal axis while being rotated about a vertical axis at constant or variable speeds. Further, the device may operate to move the ball-like object in a vertical plane by means of the primary 66 and secondary 108 pivots.

I claim:

1. A reaction development and physical training apparatus comprising:

a base located on a surface;

an upright support mounted on said base for rotation about a substantially vertical axis;

an articulated arm assembly including primary and secondary arms;

said primary arm having a first end connected by primary pivot means to the upper end of said support for movement of said articulated arm assembly in a vertical plane toward and away from selected locations;

said secondary arm having one end connected by secondary pivot means to the other end of said primary arm;

actuating means controlling the rotational movement of said support and the pivotal movement of said primary and secondary pivot means, respectively;

suction retaining means on said secondary arm free end for releasably retaining a hand graspable ball-like object;

a programmable control center supported on said base providing a programmed sequence of instructions to said actuating means for controlling said support rotational actuating means and said first and second arm pivotal actuating means operating parameters respectively;

the apparatus characterized in that the rotational movement of said support, and the pivotal movement of said first and second arms cause said ball-like object to move in predetermined paths of travel to accommodate users of different heights, ages, coordination levels, etc., while the user attempts to grasp and remove the ball-like object from said suction retaining means during said travel by employing the skills of jumping, leaping, springing and the like.

2. A basketball training and physical development apparatus, comprising:

supporting base assembly;

articulated arm assembly, including primary and secondary arms;

said primary arm having a first end connected by primary pivot means to the upper end of said support assembly for movement of said primary arm primarily in a vertical plane for controlling generally vertical movement of a basketball supported by said articulated arm assembly;

said secondary arm having one end connected by a secondary pivot means to the free end of said primary arm for controlling movement of said secondary arm relative to said primary arm;

said primary and secondary pivot means rotating and supporting said articulated arm assembly on said base assembly;

retainer means releasably retaining a basketball to the free end of said primary arm;

actuating means controlling and varying the relative movement of said primary and secondary arms; and a programmable control center providing a programed sequence of instruction to said actuating means controlling the movement of said arms relative to said supporting base assembly;

the apparatus characterized in that the rotational movement of said arms about said primary and secondary pivot means causing the basketball to move in predetermined paths of travel to accomodate users of different heights, ages and coordination levels, while the user attempts to grasp and remove the basketball from said retainer means and said basketball moving in variable arcuate paths as controlled by said control center.

3. A basketball training and physical development apparatus, comprising:

supporting base assembly;

articulated arm assembly, including primary and secondary arms;

said primary arm having a first end connected by primary pivot means to the upper end of said support assembly for movement primarily in a vertical plane for controlling generally vertical movement of a basketball supported by said articulated arm assembly;

said secondary arm assembly having one end connected by a secondary pivot means to the free end of said primary arm for controlling movement of said secondary arm relative to said primary arm;

suction retaining means, including a suction retainer on said secondary arm free end releasably retaining a basketball to said secondary arm free end, vacuum line means extending through said arms and said primary and secondary pivot means, and vacuum pump means operably connected to said suction retainer through said vacuum line means providing a source of vacuum to said suction retaining means, releasably retaining a basketball to said suction retaining means;

actuating means controlling and varying the relative movement of said primary and secondary arms; and variable control means controlling said actuating means for varying the movement of said arms in predetermined paths of travel to accomodate users of different heights, ages, coordination levels and the like while the user attempts to grasp and remove the basketball from said suction retaining means during said travel.

4. A reaction development and physical training apparatus, comprising:

a base located on a supporting surface;

an upright support rotatably mounted on said base for rotation about a substantially vertical axis;

an articulated arm assembly, including primary and secondary arms;

said primary arm having a first end connected by primary pivot means to the upper end of said support assembly for movement primarily in a vertical plane for controlling generally vertical movement of said articulated arm assembly in a generally vertical plane toward and away from said supporting surface;

said secondary arm having one end connected by a secondary pivot means to the free end of said primary arm for controlling movement of said secondary arm relative to said first arm;

retainer means releasably retaining a ball-like object to the free end of said primary arm;

actuating means controlling and varying the relative movement of said primary and secondary arms and rotational movement of said upright support; and a programmable control center providing a programed sequence of instruction to said actuating means, controlling the rotational movements of said upright support and the pivotal movement of said articulated arm assembly;

the apparatus characterized in that the rotational movement of said upright support and the pivotal movement of said articulated arm assembly cause said ball-like object to move in predetermined paths of travel to accomodate users of different heights, ages, coordination levels and the like, while the user attempts to grasp and remove the ball-like object from said retaining means during said predetermined travel.

* * * * *